US012116712B2

(12) United States Patent
Scheckelhoff et al.

(10) Patent No.: US 12,116,712 B2
(45) Date of Patent: Oct. 15, 2024

(54) RESPONSIVE SPIN CYCLE IN A WASHING MACHINE APPLIANCE

(71) Applicant: Haier US Appliance Solutions, Inc., Wilmington, DE (US)

(72) Inventors: Ryan James Scheckelhoff, Louisville, KY (US); Aaron Lee Welch, Louisville, KY (US); Kenneth G. Rudolph, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 384 days.

(21) Appl. No.: 17/494,270

(22) Filed: Oct. 5, 2021

(65) Prior Publication Data

US 2023/0104087 A1 Apr. 6, 2023

(51) Int. Cl.

| | |
|---|---|
| ***D06F 23/04*** | (2006.01) |
| ***D06F 33/38*** | (2020.01) |
| ***D06F 33/40*** | (2020.01) |
| ***D06F 34/28*** | (2020.01) |
| *D06F 101/20* | (2020.01) |
| *D06F 103/08* | (2020.01) |
| *D06F 105/48* | (2020.01) |
| *D06F 105/52* | (2020.01) |
| *D06F 105/58* | (2020.01) |

(52) U.S. Cl.

CPC ..... *D06F 33/40* (2020.02); *D06F 23/04* (2013.01); *D06F 33/38* (2020.02); *D06F 34/28* (2020.02); *D06F 2101/20* (2020.02); *D06F 2103/08* (2020.02); *D06F 2105/48* (2020.02); *D06F 2105/52* (2020.02); *D06F 2105/58* (2020.02)

(58) Field of Classification Search

None

See application file for complete search history.

(56) References Cited

U.S. PATENT DOCUMENTS

| | | | | |
|---|---|---|---|---|
| 2009/0300854 | A1 | 12/2009 | Kang | |
| 2012/0198633 | A1* | 8/2012 | Jang | D06F 33/40 8/137 |

FOREIGN PATENT DOCUMENTS

| | | | |
|---|---|---|---|
| CN | 111996768 | A | 11/2020 |
| FR | 3079849 | A1 | 10/2019 |
| JP | 3701055 | B2 | 9/2005 |
| JP | 2017153835 | A | 9/2017 |
| WO | WO2016084281 | A1 | 6/2016 |

* cited by examiner

*Primary Examiner* — Levon J Shahinian

(74) *Attorney, Agent, or Firm* — Dority & Manning, P.A.

(57) ABSTRACT

Washing machine appliances and methods of operating the same are provided. Such methods may include, and/or appliances may be configured for, performing a wash operation on laundry articles received in the wash chamber of the wash basket. After the wash operation, it may be determined that the load of articles is still wet, e.g., that a remaining moisture content of the laundry articles is above a threshold. Based on and in response to determining that the load is still wet, a spin cycle is performed before a beginning of a subsequent wash operation.

19 Claims, 3 Drawing Sheets

RESPONSIVE SPIN CYCLE IN A WASHING MACHINE APPLIANCE

FIELD OF THE INVENTION

The present subject matter relates generally to washing machine appliances, and more particularly to methods for operating washing machine appliances, and washing machine appliances that perform such methods.

BACKGROUND OF THE INVENTION

Washing machine appliances generally include a tub for containing wash liquid, e.g., water, detergent, and/or bleach, during operation of such washing machine appliances. A wash basket is rotatably mounted within the wash tub and defines a wash chamber for receipt of articles for washing, and an agitation element is rotatably mounted within the wash basket. Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or the agitation element can rotate at various speeds to agitate or impart motion to articles within the wash chamber, to wring wash fluid from articles within the wash chamber, etc.

A wash operation in a washing machine appliance may be interrupted or terminated prematurely for a variety of reasons. For example, a load of articles in the wash basket may be out of balance, the supply of electrical power to the washing machine appliance may be interrupted, or a user may manually interrupt the wash operation. As another example, the spin cycle may be paused, e.g., in response to an out of balance condition, and restarted without reaching a terminal or preferred rotational speed (such as the preferred speed to maximize moisture extraction from the articles) or the spin cycle may be otherwise limited or prevented from reaching or sustaining the terminal or preferred rotational speed. Such instances may result in diminished spin performance, e.g., excessive remaining moisture content after the wash operation is completed. Thus, the laundry articles may include a remaining moisture content and/or residual detergent that would be desirable to remove after the wash operation is completed or otherwise terminated.

Accordingly, a washing machine appliance including features and control algorithms for detecting an early termination or poor spin performance would be useful. Further, washing machine appliance including features and control algorithms that include a spin cycle in response to the detected early termination or poor spin performance would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a method of operating a washing machine appliance is provided. The washing machine appliance includes a cabinet, a wash tub mounted within the cabinet and configured for containing fluid during operation of the washing machine appliance, and a wash basket rotatably mounted within the wash tub. The wash basket defines a wash chamber configured for receiving laundry articles. The method includes performing a wash operation on laundry articles received in the wash chamber of the wash basket. The method also includes determining that a remaining moisture content of the laundry articles after the wash operation is above a threshold and performing a spin cycle in response to the remaining moisture content of the laundry articles before a beginning of a subsequent wash operation.

In another exemplary embodiment, a washing machine appliance is provided. The washing machine appliance includes a cabinet, a wash tub mounted within the cabinet and configured for containing fluid during operation of the washing machine appliance, and a wash basket rotatably mounted within the wash tub. The wash basket defines a wash chamber configured for receiving laundry articles. The washing machine appliance further includes a controller. The washing machine appliance is configured for performing a wash operation on laundry articles received in the wash chamber of the wash basket. The washing machine appliance is also configured for determining, by the controller of the washing machine appliance, that a remaining moisture content of the laundry articles after the wash operation is above a threshold. The washing machine appliance is further configured for performing a spin cycle in response to the remaining moisture content of the laundry articles before a beginning of a subsequent wash operation.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
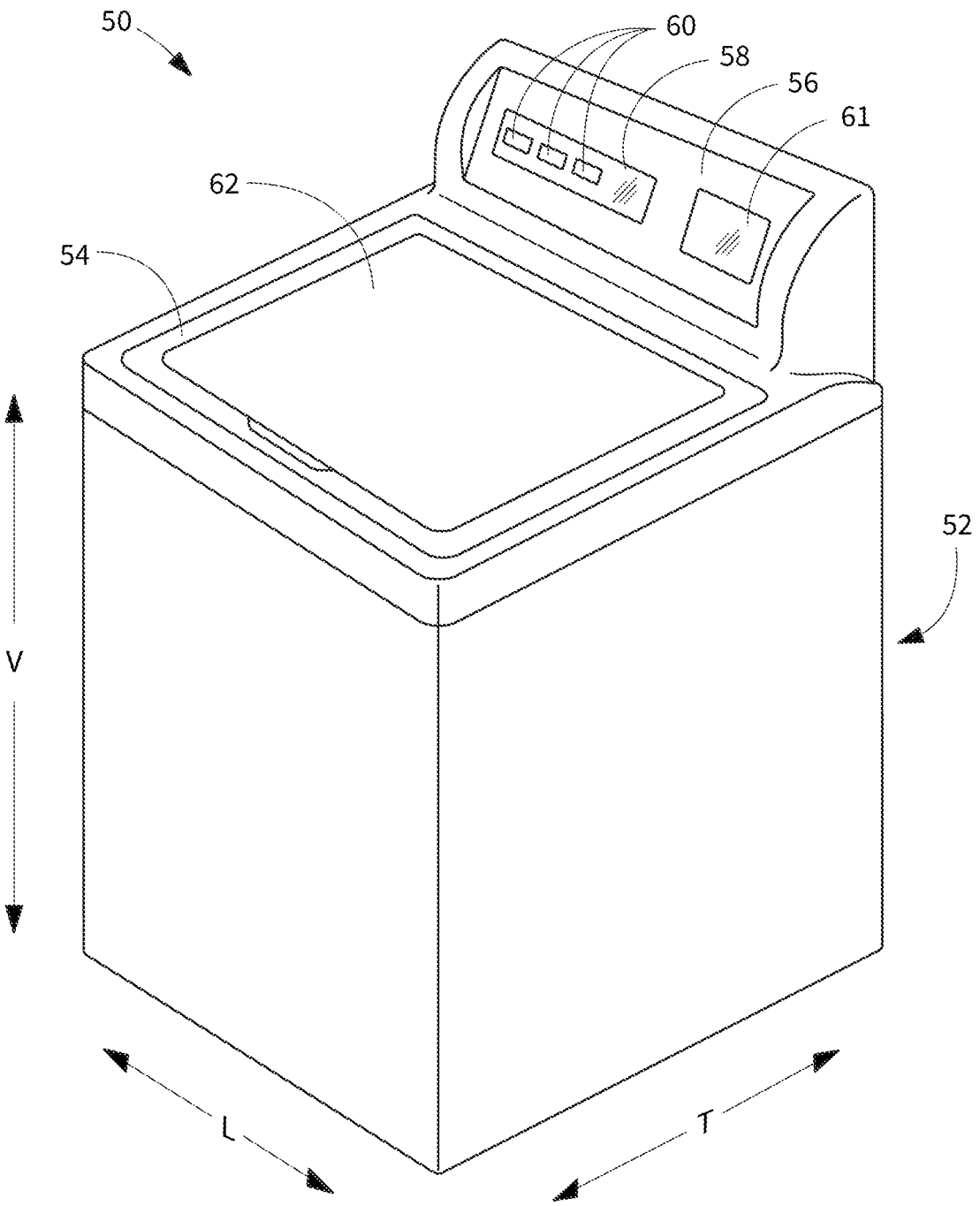
FIG. 1 provides a perspective view of a washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "clothing" or "clothes" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
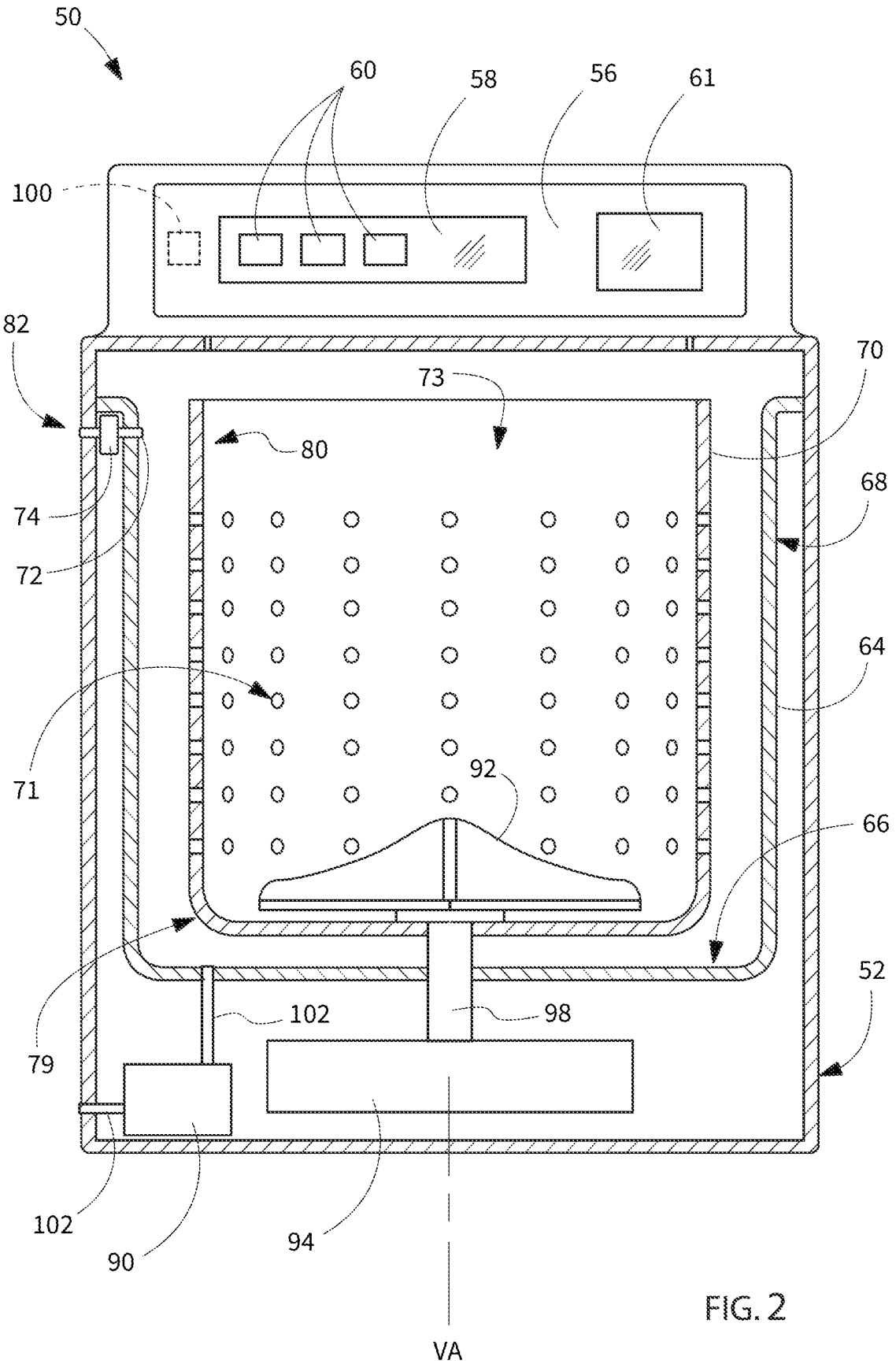
FIG. 2 provides a front, section view of the exemplary washing machine appliance of FIG. 1.

FIG. 2 provides a front, cross-section view of washing machine appliance 50. As used herein, terms such as "left" and "right" or "front" and "back" refer to directions from the perspective of a user facing the washing machine appliance 50 for accessing and/or operating the washing machine appliance 50. For example, a user stands in front of the washing machine appliance 50 to access door or lid 62 and/or inputs 60 (the door 62 and inputs 60 are described in more detail below). As may be seen in FIG. 2, wash tub 64 includes a bottom wall 66 and a sidewall 68. A wash basket 70 is rotatably mounted within wash tub 64. In particular, wash basket 70 is rotatable about a vertical axis VA. Thus, washing machine appliance is generally referred to as a vertical axis washing machine appliance. Wash basket 70 defines a wash chamber 73 for receipt of articles for washing and extends, e.g., vertically, between a bottom portion 79 and a top portion 80. Wash basket 70 includes a plurality of perforations 71 therein to facilitate fluid communication between an interior of wash basket 70 (e.g., the wash chamber 73 within the wash basket 70) and wash tub 64.

An inlet or spout 72 is configured for directing a flow of fluid into wash tub 64. The spout 72 may be a part of a fluid circulation system of the washing machine appliance, such as an inlet of the fluid circulation system. In particular, inlet 72 may be positioned at or adjacent top portion 80 of wash basket 70. Inlet 72 may be in fluid communication with a water supply (not shown) in order to direct fluid (e.g., clean water) into wash tub 64 and/or onto articles within wash chamber 73 of wash basket 70. A valve 74 regulates the flow of fluid through inlet 72. For example, valve 74 can selectively adjust to a closed position in order to terminate or obstruct the flow of fluid through inlet 72. In some embodiments, the inlet 72 may be or include a drawer, such as a detergent drawer or additive drawer, through which water flows before flowing into the wash tub 64 and/or wash chamber 73. For example, in embodiments which include the drawer, the water may mix with an additive in the drawer, thereby creating a wash liquid comprising the water and the additive dissolved therein or intermixed therewith, and the wash liquid may then flow into the wash chamber 73 via the inlet 72 (which may be at least partially defined by, e.g., a wall or other portion of the drawer in such embodiments) after a certain liquid volume or level within the drawer has been reached.

A pump assembly 90 (shown schematically in FIG. 2) is located beneath tub 64 and wash basket 70 for gravity assisted flow from wash tub 64. Pump 90 may be positioned along or in operative communication with a drain line 102 which provides fluid communication from the wash chamber 73 of the basket 70 to an external conduit, such as a wastewater line (not shown). In some embodiments, the pump 90 may also or instead be positioned along or in operative communication with a recirculation line (not shown) which extends back to the tub 64, e.g., in addition to the drain line 102.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitation element 92 is oriented to rotate about vertical axis VA. Wash basket 70 and agitation element 92 are driven by a pancake motor 94. As motor output shaft 98 is rotated, wash basket 70 and agitation element 92 are operated for rotatable movement within wash tub 64, e.g., about vertical axis VA. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a processing device or controller 100, that is operatively coupled to the user interface input located on washing machine backsplash 56 for user manipulation to select washing machine cycles and features. In response to user manipulation of the user interface input, controller 100 operates the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses. It should be noted that controllers 100 as disclosed herein are capable of and may be operable to perform any methods and associated method steps as disclosed herein.

In an illustrative embodiment, laundry items are loaded into wash chamber 73 of wash basket 70, and washing operation is initiated through operator manipulation of control input selectors 60. Wash tub 64 is filled with water and mixed with detergent to form a wash liquid. Valve 74 can be opened to initiate a flow of water into wash tub 64 via inlet 72, and wash tub 64 can be filled to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 may be moved back and forth in an oscillatory motion. The wash fluid may be recirculated through the washing machine appliance 50 at various points in the wash cycle, such as before or during the agitation phase (as well as one or more other portions of the wash cycle, separately or in addition to before and/or during the agitation phase).

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds. In various embodiments, the pump 90 may be activated to drain liquid from the washing machine appliance 50 during the entire drain phase (or the entirety of each drain phase, e.g., between the wash and rinse and/or between the rinse and the spin) and may be activated during one or more portions of the spin cycle.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
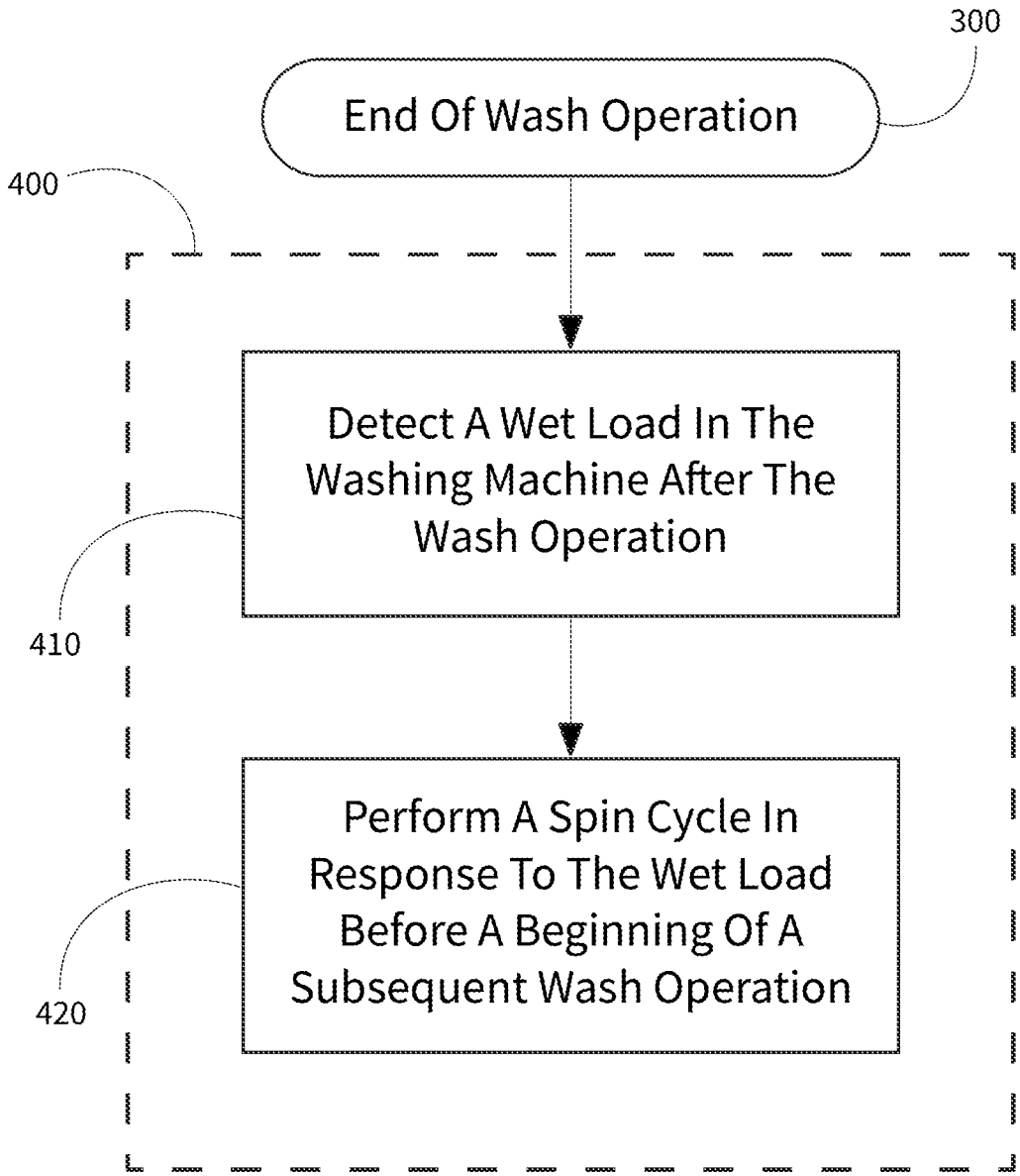
FIG. 3 illustrates a method of operating a washing machine appliance according to another exemplary embodiment of the present subject matter.

FIG. 3 illustrates an example embodiment of a method 400 of operating a washing machine appliance according to the present subject matter. Method 400 can be used to operate any suitable washing machine appliance, such as washing machine appliance 50 (FIG. 1). Method 400 may be programmed into and implemented by controller 100 (FIG. 2) of washing machine appliance 50. However, this is only by way of example, method 400 may also be used to operate various other washing machine appliances which differ from the example washing machine appliance 50.

As may be seen in FIG. 3, the method 400 may be separate and independent from a wash operation, e.g., the method 400 may be a standalone cycle which is implemented after a wash operation 300 and in response to a detected or indicated condition in the wash operation 300, such as an early termination or interruption in the wash operation 300, or other condition that correlates to or suggests a wet load in the wash basket, e.g., when the load of articles in the wash basket has an excessive remaining moisture content. For example, the method 400 may begin after the end of the wash operation 300 and may be performed, such as completely performed and/or ended, before a new, subsequent, wash operation begins.

As illustrated in FIG. 3, exemplary methods of operating the washing machine appliance 50 may include, and/or the washing machine appliance 50 may be configured for, performing a wash operation 300, e.g., on laundry articles received in the wash chamber of the wash basket. The wash operation 300 may include several phases or cycles, such as a wash cycle, a rinse cycle, a drain cycle, and one or more spin cycles. As mentioned above, the method 400 may begin after the end of the wash operation 300. For example, the method 400 may include a spin cycle which is separate from and in addition to a spin cycle or cycles of the wash operation 300 (if the wash operation 300 includes any spin cycles). When the wash operation 300 includes one or more spin cycles, and the wash operation progresses at least far enough to actually perform a spin cycle, the spin cycle at step 420 of method 400 (described in more detail below) is a supplemental or additional and separate spin cycle from any spin cycle(s) during the wash operation 300.

As illustrated at step 410 in FIG. 3, in some embodiments, the exemplary method 400 may include, and/or controller 100 may be configured for, detecting a wet load in the washing machine appliance 50 (such as in the wash basket thereof) after the wash operation, e.g., by determining that a remaining moisture content of the laundry articles after the wash operation is above a threshold. In various embodiments, the wash operation 300 may be completed prior to the method 400 or may be prematurely terminated, such as due to an out of balance condition, a power failure, a critical fault, or a user intervention, prior to the full performance of all steps/cycles of the wash operation 300. For example, an out of balance condition may be detected and the wash operation 300 may be terminated in response to the out of balance condition, such as during a final spin cycle or a wash spin cycle. As another example, the spin speed during the wash operation 300, and particularly during the final spin cycle thereof, may be limited due to an out of balance, an excessive load size, and/or a suds lock. Thus, the remaining moisture content of the articles may be greater than the threshold due to the wash operation 300 and/or a spin cycle thereof being terminated early or having limited spin speeds.

As illustrated at step 420 in FIG. 3, in some embodiments, the exemplary method 400 may include, and/or controller 100 may be configured for, after detecting the wet load, performing a spin cycle in response to the remaining moisture content of the laundry articles before a beginning of a subsequent wash operation. For example, in some embodiments, the spin cycle may be a drain and spin cycle or a rinse and spin cycle. In at least some embodiments, the selection or recommendation of the drain and spin cycle or the rinse and spin cycle in response to the wet load may be based on when or how the wet load is detected, such as when the wash operation is terminated before completion.

In some embodiments, the wash operation 300 may include a final spin cycle. In such embodiments, determining that the remaining moisture content of the laundry articles after the wash operation is above the threshold comprises determining that the wash operation terminated during the final spin cycle. In that case, the responsive spin cycle at step 420 of method 400 may be a drain and spin cycle. For example, the drain and spin cycle may include draining water from the tub, e.g., by activating the drain pump, and then rotating the wash basket at an extraction speed, such as a maximum extraction speed, to wring moisture from the articles therein, and the drain and spin cycle may not include adding any water or other additives to the wash basket or wash tub. Also in embodiments where the wash operation 300 includes the final spin cycle, determining that the remaining moisture content of the laundry articles after the wash operation is above the threshold may include determining that a maximum spin speed during the final spin cycle is less than a maximum extraction speed. As another example when the wash operation 300 includes the final spin cycle, determining that the remaining moisture content of the laundry articles after the wash operation is above the threshold may include determining that a time duration during which the maximum spin speed of the final spin cycle exceeded a maximum extraction speed is less than a predetermined time limit. For example, the method 400 may include, and/or the controller 100 may be configured for, determining whether the spin speed for the final spin cycle of the wash operation 300 did not get above X RPM (e.g., where X represents an extraction speed, such as max extraction speed) for longer than Y time (e.g., in minutes), where Y represents the predetermined time limit.

In some embodiments, the wash operation 300 may include a wash spin cycle. In such embodiments, determining that the remaining moisture content of the laundry articles after the wash operation is above the threshold may include determining that the wash operation terminated during the wash spin cycle. Thus, the spin cycle at step 420 in response to the remaining moisture content of the laundry articles may be a rinse and spin cycle. For example, the rinse and spin cycle may include adding a rinse volume of water to the wash tub prior to rotating the wash basket at an extraction speed, such as a maximum extraction speed. For example, the rinse and spin cycle may include adding the rinse volume, draining the wash tub after adding the rinse volume, and then rotating the wash basket after rinsing and draining.

In some embodiments, the wash operation 300 may include a rinse cycle. In such embodiments, the spin cycle of step 420 may be the rinse and spin cycle when the wash operation 300 terminates prior to or during the rinse cycle of the wash operation 300, and the spin cycle of step 420 may be the drain and spin cycle when the wash operation 300 terminates after the rinse cycle of the wash operation 300. For example, determining that the remaining moisture content of the laundry articles after the wash operation is above the threshold may include determining that the wash operation terminated before the rinse cycle, and thus the spin cycle in response to the remaining moisture content of the laundry articles may be the rinse and spin cycle.

In various embodiments, the responsive spin cycle of step 420 may be performed automatically or in response to a user input. For example, the responsive spin cycle of step 420 may be performed automatically immediately after detecting the wet load or may be performed automatically the next time a user interface of the washing machine is activated, such as by pushing an "ON" button or power button of the input selectors 60 on the control panel 58. For example, the spin cycle in response to the remaining moisture content of the laundry articles at step 420 may be performed automatically after determining that the remaining moisture content of the laundry articles after the wash operation is above the threshold.

In some embodiments, the method 400 may include, and/or the washing machine appliance 50 may be configured for, providing a user notification after determining that the remaining moisture content of the laundry articles after the wash operation is above the threshold. The user notification may be provided on a user interface of the washing machine appliance or on a remote user interface, such as on a smartphone, tablet, personal computer, smart home system or other similar device that is not physically connected to the washing machine appliance. For example, the user notification may be provided in an application or "app" running on a smart phone that communicates wirelessly with the washing machine appliance. In such embodiments, the method 400 may further include, and/or the washing machine appliance may be further configured for, receiving an input from a control input selector of the washing machine appliance responsive to the user notification, and then performing the spin cycle in response to the received input. For example, the user notification may include illuminating, e.g., blinking, an indicator associated with the spin cycle. The user notification may also or instead include a text notification recommending the responsive spin cycle (e.g., drain and spin cycle or rinse and spin cycle, as described above) on the display 61 and/or on a remote user interface device such as a smartphone, as mentioned above.

In some embodiments, determining that the remaining moisture content of the laundry articles after the wash operation is above the threshold may include detecting detergent within the washing machine appliance, e.g., the presence of detergent may also at least imply the presence of moisture, such as wash liquid which the detergent is dissolved in and/or intermixed with. In such embodiments, the spin cycle in response to the remaining moisture content of the laundry articles may be the rinse and spin cycle. For example, the washing machine appliance 50 may include one or more sensors, such as a turbidity sensor, and the detergent within the washing machine appliance may be detected with such sensors, such as by measuring or detecting a turbidity of wash liquid within the washing machine appliance, where a turbidity above a predetermined threshold limit may indicate the presence of detergent in the washing machine appliance 50.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a cabinet, a wash tub mounted within the cabinet and configured for containing fluid during operation of the washing machine appliance, and a wash basket rotatably mounted within the wash tub, the wash basket defining a wash chamber configured for receiving laundry articles, the method comprising:

performing a wash operation on laundry articles received in the wash chamber of the wash basket;

determining that a remaining moisture content of the laundry articles after the wash operation is above a threshold;

performing a spin cycle in response to the remaining moisture content of the laundry articles before a beginning of a subsequent wash operation;

providing a user notification after determining that the remaining moisture content of the laundry articles after the wash operation is above the threshold; and receiving an input from a control input selector of the washing machine appliance responsive to the user notification, wherein the step of performing the spin cycle is performed in response to the received input.

2. The method of claim 1, wherein the wash operation comprises a final spin cycle, wherein determining that the remaining moisture content of the laundry articles after the wash operation is above the threshold comprises determining that the wash operation terminated during the final spin cycle, and wherein the spin cycle in response to the remaining moisture content of the laundry articles is a drain and spin cycle.

3. The method of claim 1, wherein the wash operation comprises a wash spin cycle, wherein determining that the remaining moisture content of the laundry articles after the wash operation is above the threshold comprises determining that the wash operation terminated during the wash spin cycle, and wherein the spin cycle in response to the remaining moisture content of the laundry articles is a rinse and spin cycle.

4. The method of claim 1, wherein the wash operation comprises a rinse cycle, wherein determining that the remaining moisture content of the laundry articles after the wash operation is above the threshold comprises determining that the wash operation terminated before the rinse cycle, and wherein the spin cycle in response to the remaining moisture content of the laundry articles is a rinse and spin cycle.

5. The method of claim 1, wherein the wash operation comprises a final spin cycle, wherein determining that the remaining moisture content of the laundry articles after the wash operation is above the threshold comprises determining that a maximum spin speed during the final spin cycle is less than a maximum extraction speed.

6. The method of claim 1, wherein the wash operation comprises a final spin cycle, wherein determining that the remaining moisture content of the laundry articles after the wash operation is above the threshold comprises determining that a time duration during which the maximum spin speed of the final spin cycle exceeded a maximum extraction speed is less than a predetermined time limit.

7. The method of claim 1, wherein determining that the remaining moisture content of the laundry articles after the wash operation is above the threshold comprises detecting detergent within the washing machine appliance, and wherein the spin cycle in response to the remaining moisture content of the laundry articles is a rinse and spin cycle.

8. A washing machine appliance, comprising:

a cabinet;

a wash tub mounted within the cabinet and configured for containing fluid during operation of the washing machine appliance;

a wash basket rotatably mounted within the wash tub, the wash basket defining a wash chamber configured for receiving laundry articles; and a controller, wherein the washing machine appliance is configured for:

performing a wash operation on laundry articles received in the wash chamber of the wash basket;

determining, by the controller of the washing machine appliance, that a remaining moisture content of the laundry articles after the wash operation is above a threshold;

performing a spin cycle in response to the remaining moisture content of the laundry articles before a beginning of a subsequent wash operation;

providing a user notification after determining that the remaining moisture content of the laundry articles after the wash operation is above the threshold; and receiving an input from a control input selector of the washing machine appliance responsive to the user notification, wherein the step of performing the spin cycle is performed in response to the received input.

9. The washing machine appliance of claim 8, wherein the wash operation comprises a final spin cycle, wherein determining that the remaining moisture content of the laundry articles after the wash operation is above the threshold comprises determining that the wash operation terminated during the final spin cycle, and wherein the spin cycle in response to the remaining moisture content of the laundry articles is a drain and spin cycle.

10. The washing machine appliance of claim 8, wherein the wash operation comprises a wash spin cycle, wherein determining that the remaining moisture content of the laundry articles after the wash operation is above the threshold comprises determining that the wash operation terminated during the wash spin cycle, and wherein the spin cycle in response to the remaining moisture content of the laundry articles is a rinse and spin cycle.

11. The washing machine appliance of claim 8, wherein the wash operation comprises a rinse cycle, wherein determining that the remaining moisture content of the laundry articles after the wash operation is above the threshold comprises determining that the wash operation terminated before the rinse cycle, and wherein the spin cycle in response to the remaining moisture content of the laundry articles is a rinse and spin cycle.

12. The washing machine appliance of claim 8, wherein the wash operation comprises a final spin cycle, wherein determining that the remaining moisture content of the laundry articles after the wash operation is above the threshold comprises determining that a maximum spin speed during the final spin cycle is less than a maximum extraction speed.

13. The washing machine appliance of claim 8, wherein the wash operation comprises a final spin cycle, wherein determining that the remaining moisture content of the laundry articles after the wash operation is above the threshold comprises determining that a time duration during which the maximum spin speed of the final spin cycle exceeded a maximum extraction speed is less than a predetermined time limit.

14. The washing machine appliance of claim 8, wherein determining that the remaining moisture content of the laundry articles after the wash operation is above the threshold comprises detecting detergent within the washing machine appliance, and wherein the spin cycle in response to the remaining moisture content of the laundry articles is a rinse and spin cycle.

15. A method of operating a washing machine appliance, the washing machine appliance comprising a cabinet, a wash tub mounted within the cabinet and configured for containing fluid during operation of the washing machine appliance, and a wash basket rotatably mounted within the wash tub, the wash basket defining a wash chamber configured for receiving laundry articles, the method comprising:

performing a wash operation on laundry articles received in the wash chamber of the wash basket;

determining that a remaining moisture content of the laundry articles after the wash operation is above a threshold, wherein determining that the remaining moisture content of the laundry articles after the wash operation is above the threshold comprises detecting detergent within the washing machine appliance; and performing a spin cycle in response to the remaining moisture content of the laundry articles before a beginning of a subsequent wash operation, wherein the spin cycle in response to the remaining moisture content of the laundry articles is a rinse and spin cycle.

16. The method of claim 15, wherein the spin cycle in response to the remaining moisture content of the laundry articles is performed automatically after determining that the remaining moisture content of the laundry articles after the wash operation is above the threshold.

17. The method of claim 15, wherein the wash operation comprises a rinse cycle, wherein determining that the remaining moisture content of the laundry articles after the wash operation is above the threshold comprises determining that the wash operation terminated before the rinse cycle.

18. The method of claim 15, wherein the wash operation comprises a final spin cycle, wherein determining that the remaining moisture content of the laundry articles after the wash operation is above the threshold comprises determining that a maximum spin speed during the final spin cycle is less than a maximum extraction speed.

19. The method of claim 15, wherein the wash operation comprises a final spin cycle, wherein determining that the remaining moisture content of the laundry articles after the wash operation is above the threshold comprises determining that a time duration during which the maximum spin speed of the final spin cycle exceeded a maximum extraction speed is less than a predetermined time limit.

* * * * *